US007644503B2

(12) United States Patent
Lewis

(10) Patent No.: US 7,644,503 B2
(45) Date of Patent: Jan. 12, 2010

(54) BOW SIGHT

(75) Inventor: Kenneth D. Lewis, Wisconsin Rapids, WI (US)

(73) Assignee: KDL Outdoor Products, Inc., Wisconsin Rapids, WI (US)

( * ) Notice: Subject to any disclaimer, the term of this patent is extended or adjusted under 35 U.S.C. 154(b) by 110 days.

(21) Appl. No.: 11/944,491

(22) Filed: Nov. 23, 2007

(65) Prior Publication Data

US 2009/0133272 A1 May 28, 2009

(51) Int. Cl.
*F41G 1/467* (2006.01)

(52) U.S. Cl. ..... 33/265; 124/87

(58) Field of Classification Search ..... 33/265; 124/87; D22/100, 107
See application file for complete search history.

(56) References Cited

U.S. PATENT DOCUMENTS

| | | | | |
|---|---|---|---|---|
| 2,163,503 | A | 6/1939 | Tate | |
| 2,351,103 | A | 6/1944 | Brown | |
| 2,559,927 | A * | 7/1951 | Beloungy | 33/265 |
| 2,893,124 | A | 7/1959 | Sundquist | |
| 3,284,904 | A | 11/1966 | Rade | |
| 3,488,853 | A | 1/1970 | Altier | |
| 3,648,376 | A * | 3/1972 | Millnamow | 33/265 |
| 4,481,717 | A | 11/1984 | Kowalski | |
| 4,497,116 | A * | 2/1985 | Hawkins | 33/265 |
| 4,528,973 | A | 7/1985 | Rasmussen | |
| 4,541,179 | A | 9/1985 | Closson | |
| 5,040,300 | A * | 8/1991 | Sheffield | 33/265 |
| 5,092,052 | A | 3/1992 | Godsey | |
| 5,201,122 | A | 4/1993 | Annunziata | |
| 5,454,169 | A * | 10/1995 | Keller | 33/265 |
| 5,524,351 | A * | 6/1996 | Pinson et al. | 33/265 |
| 5,694,698 | A | 12/1997 | Slates | |
| 5,718,215 | A | 2/1998 | Kenny et al. | |
| 5,914,775 | A | 6/1999 | Hargrove et al. | |
| 6,061,919 | A | 5/2000 | Reichert | |
| 6,079,111 | A * | 6/2000 | Williams et al. | 33/265 |
| 6,493,951 | B1 | 12/2002 | Smith et al. | |
| 6,609,306 | B2 | 8/2003 | Johnson et al. | |
| 6,802,129 | B1 | 10/2004 | Wirth | |
| 6,823,597 | B2 | 11/2004 | Larson | |
| 6,851,197 | B2 | 2/2005 | Terry et al. | |
| 6,868,614 | B2 * | 3/2005 | Floied et al. | 33/265 |

(Continued)

OTHER PUBLICATIONS

"Are you ready to go Peepless?" Kingsway Archery, Archery Business, Nov.-Dec. 2007.

*Primary Examiner*—R. Alexander Smith
(74) *Attorney, Agent, or Firm*—Stiennon & Stiennon

(57) ABSTRACT

An archery bow sight has a sight tube which is fixed to a link arm which extends between two rotatable members mounted to a frame which is connected to the riser of a bow. The arm is pinned to the rear rotatable member at a radius which is less than the radius at which it is pinned to the front rotatable member. The rotation of the rotatable members is synchronized by a connector such as an intermediate gear, a timing belt, a rigid link, or a linked chain. By rotation of a range adjustment knob, the sight tube is caused to change simultaneously in inclination and in height in such a way that the archer may continue to view the target through the sight tube. The sight tube has a fiber optic sight point. The relationship between the rotating members and the link arm is adjustable for draw length.

24 Claims, 6 Drawing Sheets

U.S. PATENT DOCUMENTS 6,892,462 B2 5/2005 Rager
6,925,721 B2 8/2005 Dietz
6,938,349 B2 9/2005 Afshari
7,086,161 B2 8/2006 Ellig et al.
7,360,313 B1 * 4/2008 Hamm et al. ..... 33/265

* cited by examiner

FIG. 9
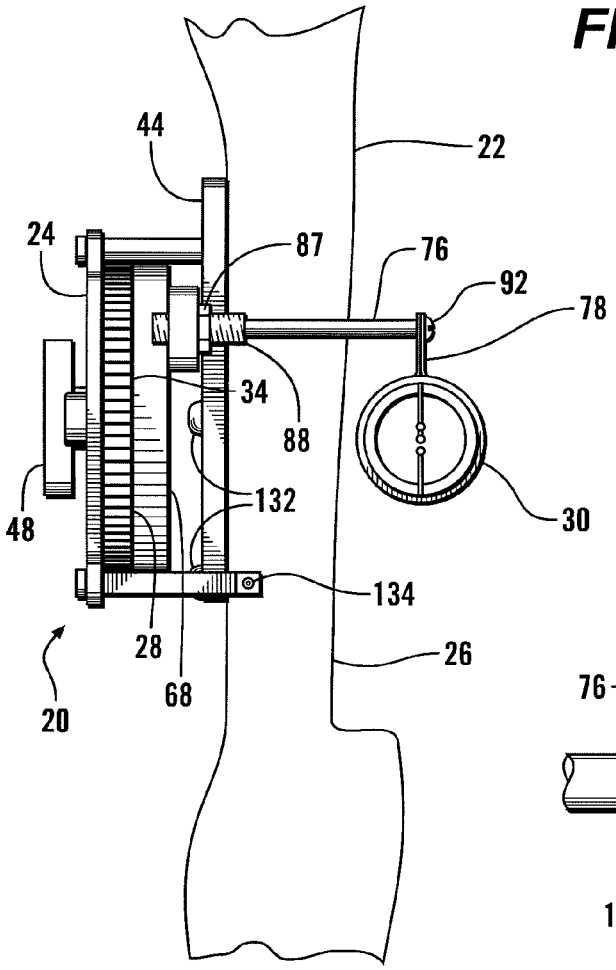
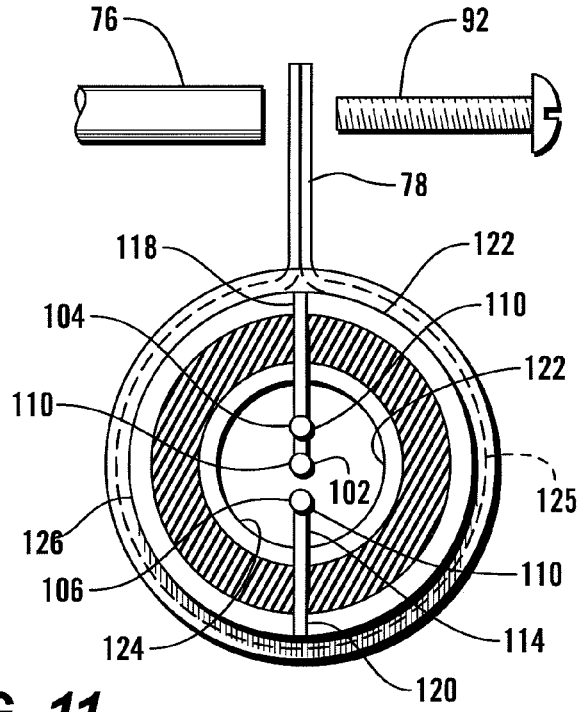
FIG. 11

BOW SIGHT

BACKGROUND OF THE INVENTION

The present invention relates to a bow sight for an archery bow.

Modern bows and accessories have made possible a greater degree of accuracy in target shooting and hunting. Many varieties of sights have been developed for the bow. One common type of bow sight employs an array of adjustable pins mounted to the bow with a sighting device or "peep" attached to the bowstring. Yet the peep mounted to the string can visually obstruct the target area. Because the peep is fixed to the string, range adjustments can require the archer to modify the orientation of the bow in a way that can compromise repeatability.

What is needed is a simple and accurate archery sight that can be entirely mounted to the bow without the need for any sight element on the string.

SUMMARY OF THE INVENTION

The bow sight of this invention has a sight tube (which may be comprised of several axially spaced shorter tubes) which is fixed to a pivotable link arm which extends between two rotatable members mounted to a frame which is connected to the riser of a bow. The arm is pinned to the rear rotatable member at a radius which is less than the radius at which it is pinned to the front rotatable member. The rotation of the rotatable members is synchronized by a connector such as an intermediate gear, a timing belt, a rigid link, or a linked chain. By rotation of a range adjustment knob, the sight tube is caused to change simultaneously in inclination and in height in such a way that the archer may continue to view the target through the sight tube. The sight tube may be provided with a fiber optic sight point. A dial pointer on one of the rotatable discs may provide a convenient indicator of the sighting range on a cover plate of the frame. The relationship between the rotating members and the link arm may be adjusted to take into account the draw length of a particular user. Alternatively, the sight tube may have two axially spaced tube portions, with the tube closer to the archer being narrower in diameter, giving a sight picture that is minimally obstructive of the target.

It is an object of the present invention to provide an archery bow sight which mounts entirely to the bow riser.

It is another object of the present invention to provide an archery bow sight which is adjustable for the draw length of a particular archer.

It is a further object of the present invention to provide an archery bow sight with a sight tube which is effective at twilight light levels.

Further objects, features and advantages of the invention will be apparent from the following detailed description when taken in conjunction with the accompanying drawings.

BRIEF DESCRIPTION OF THE DRAWINGS

FIG. 9 is a rear elevational view of the sight of FIG. 5 mounted to a bow.

FIG. 11 is a rear perspective view of the sight tube of the sight mounted to the bow of FIG. 9.

DESCRIPTION OF THE PREFERRED EMBODIMENTS

Figure 2:
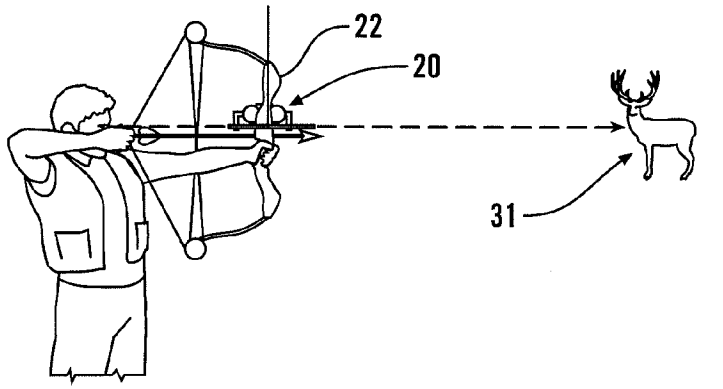
FIG. 2 is a schematic view of a hunter using a bow with the sight of this invention aiming at a near target.
Figure 4:
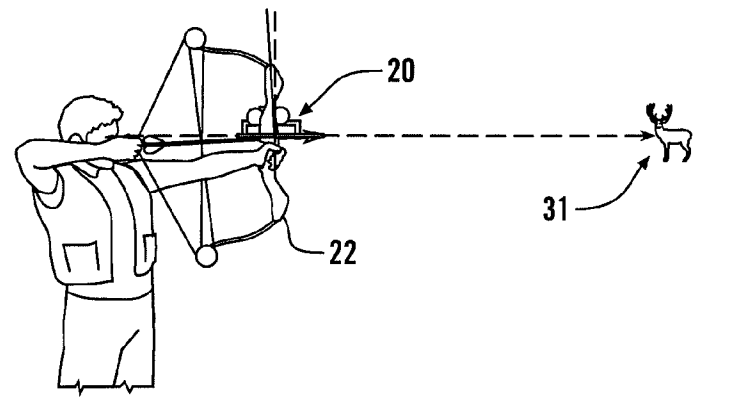
FIG. 4 is a schematic view of a hunter using a bow with the sight of this invention aiming at a distant target.
Figure 1:
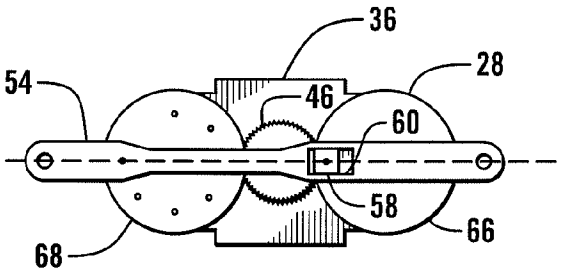
FIG. 1 is a schematic view of the bow sight of this invention adjusted for a near target.
Figure 3:
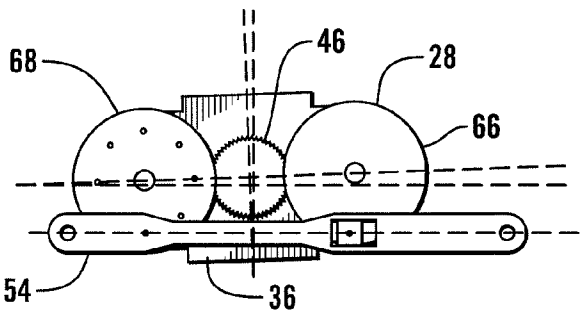
FIG. 3 is a schematic view of the bow sight of FIG. 1 adjusted for a distant target.
Figure 5:
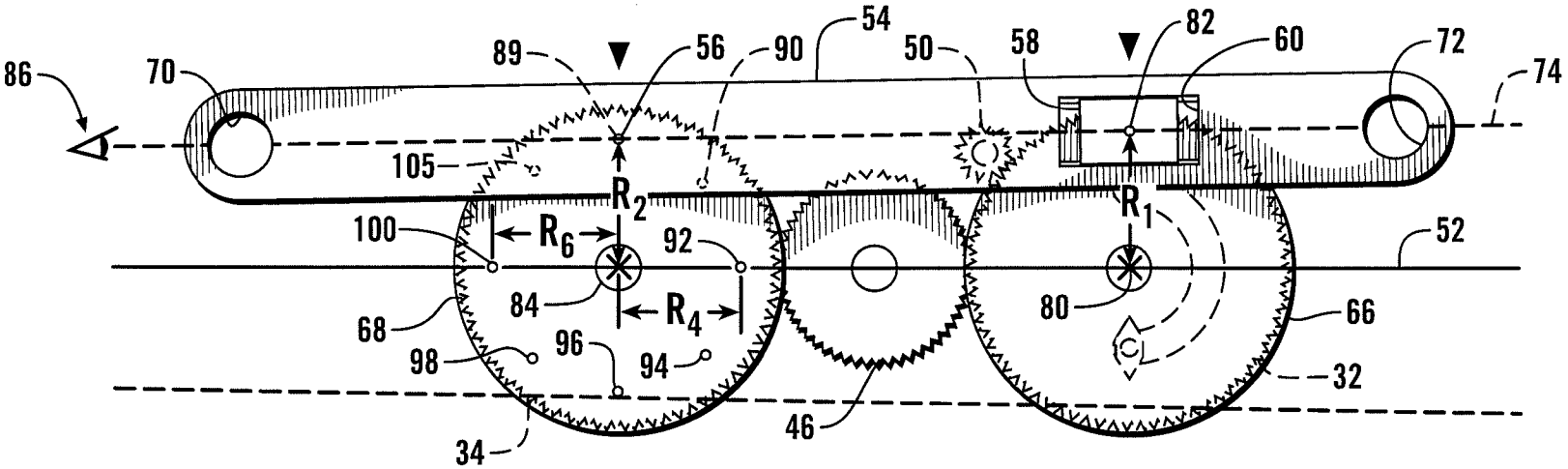
FIG. 5 is a side elevational view of the bow sight of this invention partially broken away in section.
Figure 10:
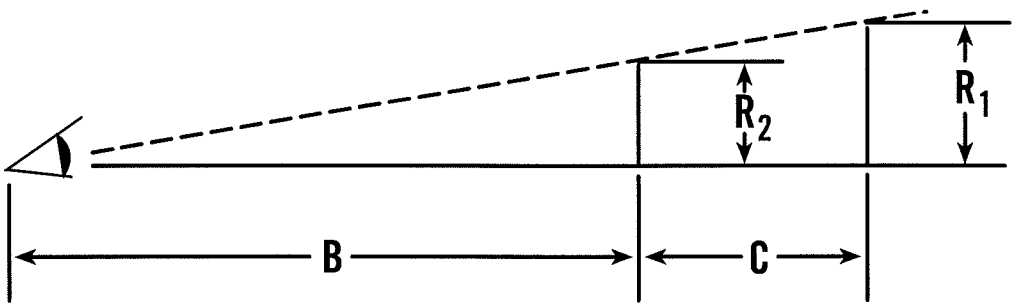
FIG. 10 is a schematic view of the relationship between the radial lengths of the rotatable members and the draw length of the archer.
Figure 6:
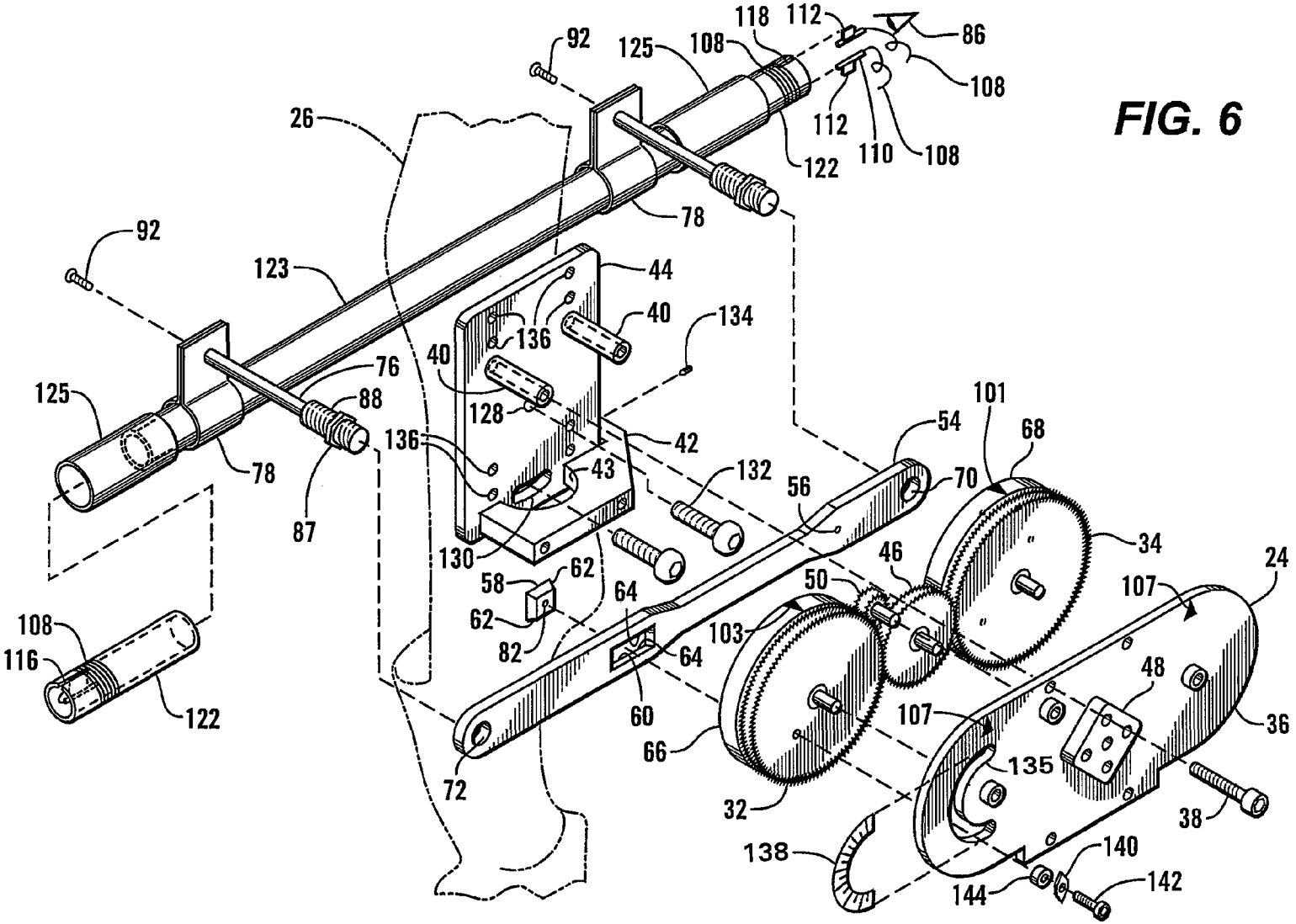
FIG. 6 is an exploded isometric view of the bow sight of FIG. 5.

Referring more particularly to FIGS. 1-15, wherein like numbers refer to similar parts, a bow sight 20 is shown in FIG. 6. In FIGS. 2 and 4 the sight 20 is shown mounted to a conventional compound bow 22, although the sight may be used with other types of bows. As shown in FIGS. 6 and 9, the sight 20 has a frame 24 which is mounted to the vertical riser 26 of the bow 22. As shown in FIG. 6, an adjustment mechanism 28 is mounted to the frame 24, and a sight tube 30 is supported by the adjustment mechanism. The adjustment mechanism 28 allows the sight tube 30 to be adjusted for the range to the target 31 and for the draw length of a particular archer and bow. The frame 24 has features which allow the sight to be adjusted for the archer's draw point and the windage.

As shown in FIG. 5, the adjustment mechanism 28 has two rotatable members which may be a front gear 32 and a rear gear 34 which are rotatably mounted to a cover plate 36 which forms part of the frame 24. The cover plate 36 is connected to a mounting plate 44 by screws 38 which extend through upper spacers 40 and a lower spacer bar 42. The front gear 32 is synchronized with the rear gear 34 by a center gear 46 which serves as a synchronizing connector between the other two gears. The center gear 46 is also rotatably mounted to the cover plate 36, and is provided with a range adjustment knob 48, as shown in FIG. 6. The front gear 32 and the rear gear 34 have like numbers of teeth, for example one hundred and eight, while the center gear has half as many teeth, fifty-four. As shown in FIG. 5, a fine adjustment gear 50 may optionally be provided, also rotatably mounted to the cover plate 36. The fine adjustment gear 50 may have eighteen teeth, and engages the front gear 32.

As shown in FIG. 5, the front gear 32, the center gear 46, and the rear gear 34 are mounted to the cover plate 36 to rotate about axes which all lie on a common main axis line 52. A link arm 54 extends between and is rotatably pinned to the front gear 32 and the rear gear 34 by being attached to a front disc 66 which is fixed to the front gear, and a rear disc 68 which is fixed to the rear gear. The link arm 54 is pinned to the rear disc 68 at an arm rear bearing hole 56, and is connected to the front disc 66 by a slider 58 which travels in a slot 60 in the link arm. The slider 58, as shown in FIG. 6, is a block with beveled sides 62. The slider block is pivotably connected to the front disc 66, and it moves lengthwise in engagement with the inclined walls 64 of the link arm 54 slot 60. The inclined walls 64 of the slot 60 engage the beveled sides 62 of the slider 58 and contribute to the smooth and quite operation of the sight.

The ends of the link arm 54 have a rear mounting hole 70 and a front mounting hole 72. The mounting holes 70, 72 are positioned along a central axis 74 of the link arm, and receive tube spacer rods 76 which extend sidewardly to the link arm 54, as shown in FIG. 9. The sidewardly extending tube spacer rods 76 are terminated by clamps 78 which engage the sight tube 30. Thus the elevation and inclination of the link arm 54 corresponds to the elevation and inclination of the sight tube 30. When viewed from the side, as in FIG. 5, the distance between the rotational axis 80 of the front disc 66 and the front bearing hole 82 in the slider 58 is $R_1$. Viewed from the same vantage point, the distance between the rotational axis 84 of the rear disc 68 and the rear bearing hole 56 is a distance $R_2$ which is less than $R_1$. As discussed in more detail below, this second distance may be adjusted to take into account the draw length of a particular archer, but will always be less than $R_1$. The geometry of this arrangement is shown diagramatically and not to scale in FIG. 10. The distance from the archer's eye 86 to the rotational axis 84 of the rear disc is B, while the distance between the rotational axis 84 of the rear disc and the rotational axis 80 of the front disc is C. The adjustment mechanism 28 operates to keep the sight tube always arranged with respect to the archer's eye 86 such that the archer can look through the sight tube without having to move the bow vertically. In order to maintain this relationship, it is necessary to arrange the distances between the rotational axes of the discs/gears, the distance from those axes to the attachment points of the link arm, and the distance from the rear axis to the eye of the archer to satisfy the following relationship.

$$\frac{B}{B+C} = \frac{R_2}{R_1}$$

The effect from the archer's point of view, then, of adjusting the range adjustment knob 48, is that the sight tube appears to pivot about an axis at the archer's eye. Hence, as shown in FIG. 11, the archer can continue to look directly through the sight tube and align the fiber optic markers on the target, as described below.

The distance from the archer's eye to the rear disc rotational axis depends on the draw length of a particular archer. The draw length, which may depend on a number of factors, including bow string tension, archer strength and height, etc., will vary over a length of about a foot. In order to maintain the desired relationship noted above, it is necessary to adjust the ratio of $R_2$ to $R_1$ to match the particular archer's draw length.

When an archer is first installing the bow sight 20 on a particular bow 22 it is necessary to measure the draw length and make a corresponding adjustment to the sight. As shown in FIGS. 5 and 6, the rear disc 68 is provided with an array of mounting holes 89, 90, 92, 94, 96, 98, 100, 105. To modify the sight 20 to adjust for a particular draw length, the user removes a pin, not shown, and reinserts the pin through the rear bearing hole 56 of the link arm 54 and into one of the mounting holes 89, 90, 92, 94, 96, 98, 100, 105. The rear disc 68 and associated rear gear 34 are separated from the cover plate and thus disengaged from the center gear 46, allowing the rear gear to be repositioned with respect to the front gear. The rear disc 68 is provided with register marks 101 which align with each of the mounting holes. The front disc 66 has a single register mark 103. Two register marks 107 are provided corresponding to the 12 o'clock positions of the discs 66, 68 located on the outside of the cover plate 36.

The cover plate 36 has a curved slot 135 which has an axis of curvature corresponding to the axis of the front gear 32. A range read-out sticker 138, as shown in FIG. 6, is affixed to the cover plate alongside the slot 135 to permit a particular archer to indicate thereon the positions which correspond to particular ranges for that archer. The range read-out may have sixty marks, corresponding to 60 yards. An additional sticker may be placed on the same face of the cover plate but along the opposite inside curve of the slot 135. The additional sticker, not shown, may have marks indicating every ten yards of range. A range dial head 140 is mounted on a fastener 142 which is fixed to the front gear 32. A spacer 144 positions the dial head 140 to travel overlying the sticker 138 to indicate the desired distance on the sticker scale. The dial head 140 may have dual pointers to indicate range on two opposed stickers.

The radial distance between each mounting hole and the rotational axis 84 of the rear disc is different. For example, the radius of the first mounting hole 89 may be about 35/1000 inches less than the radius $R_1$, while the radius of the second mounting hole 90, may be 5/1000 inches less than that, and the radius $R_4$ of the third mounting hole 92, may be another 5/1000 inches less, and so forth. If the radius $R_1$ is about ¾ inches, and the distance between the axes of the two discs is about 3½ inches, then each five thousandths of an inch change in $R_2$ will accommodate about two inches of draw length change.

The side-to-side positioning of the sight tube 30 may be adjusted by adjusting the positioning of the rods 76 with respect to the link arm 54. Each rod 76 has a threaded portion 88, as shown in FIG. 9. A lock nut 87 adjacent the link arm 54 may be adjusted to move the rod and control the spacing of the sight tube from the link arm. A screw 92 fastens the clamp 78 to the end of the rod 76. If the distance between the sight tube and the link arm is kept the same on both rods 76, the device may be adjusted for an archer's eye placement. If, for example, the string is in the way of the sight tube, the positioning of the sight tube may be adjusted sidewardly. If one rod is adjusted more than another, the sight tube may be tilted in a horizontal plane, allowing for windage adjustment in the flight of the arrow.

Once the archer has adjusted the sight 20 for draw length, further one-time adjustments may be made. For example, if the broadhead of the arrow, not shown, touches the sight, the entire sight may be raised or pivoted on the frame mounting plate as discussed below.

As shown in FIG. 11, the sight tube 30 has a far marker 102 which is centered within the tube, and an upper near marker 104 and a lower near marker 106 which are aligned one above the other. When the three markers 102, 104, 106 are aligned vertically such that the far marker 102 is centered between the near markers 104, 106, the bow is properly sighted. As shown in FIG. 6, the markers are defined by very narrow diameter optical fibers 108, for example about 0.015 inches in diameter. The fibers 108 are shown schematically in the exploded view of FIG. 6. An end of each fiber 108 is received within a narrow tube 110 in a molded plastic sight pin 112. The position of the fiber 108 may be adjusted axially within the sight pin tube 110, so that the distance from the end of the tube and the end of the fiber may be controlled. Each sight pin 112 has a radially extending tab 114 which allows the sight pin tube 110 to be positioned at a desired radial position within the sight tube 30. A sight pin 112 is received within a far end slot 116 formed on the sight tube, and two other sight pins 112 are received at the near end of the tube within an upper slot 118 and a lower slot 120. The tabs 114 of the sight pins 112 are fixed within the slots to position the sight pin tubes 110 at the desired radial position within the sight tube 30. The near and far end of the sight tube 30 are preferably formed of transparent acrylic cylinders 122 with the far and near surfaces respectively of the tube cylinders 122 coated with contrasting colors of fluorescent paint. For example, the far surface of the far cylinder 122 can be painted red, while the near surface of the near cylinder can be painted green, to produce the effect of a red ring 124 centered within a green ring 126.

The cylinders may have about ⅛ inch thick walls. The cylinders 122 may be connected to a main segment 123 with connective sleeves 125. While one end of each optical fiber 108 is received within the tube 110 of the sight pin 112, the other end extends axially along the tube 110 and is wrapped multiple times around the transparent cylinder. The terminating end of the optical fiber 108 is preferably fixed in place by the wrapping of the fiber around it on the transparent cylinder. By having the extended length of the fiber on the exterior of the cylinder, greater light gathering can take place, with the result that the end of the fiber fitted in the sight pin tube 110 will provide greater illumination as it serves as a marker. The greater light gathering power facilitates use of the sight in lower light conditions. In some brighter lighting conditions, on the other hand, the appearance of the end of the fiber may be indistinct or haloed, due to the intensity of the light. This effect can be minimized by withdrawing the fiber end axially within the sight pin tube a fraction of an inch. To improve the contrast within the sight tube, it is preferably sprayed with glue to which small fibers or flock is applied, yielding a matte black interior.

When the archer has designated the desired target, an estimate of the range is made, and the range adjustment knob 48 is rotated until the range dial head 140 indicates that range. The archer then draws the arrow and positions the bow such that the target appears in the sight tube 30 with the far marker 102 is on the target and vertically between the two near markers 104, 106. The arrow is then released to strike the target.

The frame mounting plate 44 is preferably provided with two attachment holes which are compatible with the AMO (Archer Manufacturers and Merchants Organization, Gainesville, Fla.) bow sight & accessory mounting holes standard. The AMO standard calls for two threaded holes in the bow riser 26 spaced one above the other such that a line through the axes of the holes is parallel to the bowstring. The mounting plate 44 has an upper mounting hole 128 and an arcuate lower mounting slot 130 positioned below the upper mounting hole, as shown in FIG. 6. Mounting screws 132 then fix the mounting plate 44 to the side face of the riser 26 as shown in FIG. 9. The inclination of the mounting plate can be adjusted by loosening the mounting screws 132, such that the entire sight 20 can be pivoted about the upper mounting screw. The lower mounting screw is loosened only so much that the mounting plate 44 can be adjusted under pressure. The lower spacer bar 42 may be provided with a clearance opening 43 to permit access to the head of the lower mounting screw 132. The precise adjustment of the inclination of the mounting plate 44 is then controlled by adjusting an inclination set screw 134 which engages the rear surface of the bow riser 26. The inclination set screw 134 extends through a foot of the lower spacer bar 42 and engages the bow riser 26. When appropriately adjusted, the upper and lower mounting screws 132 are tightened to secure the bow sight 20 in place.

As shown in FIG. 6, the adjustment mechanism 28 may be adjusted vertically by selecting which of three sets of attachment holes 136 to use in connecting the cover plate screws 38 to the mounting plate 44. The sight 20 has been shown mounted to the bow 22 for a left-handed archer. For a right-handed archer, the sight 20 would be mounted on the opposite side from the one shown. To convert the mounting for right-handed archer, the mounting plate is rotated 180 degrees about a vertical axis, and affixed on the opposite side of the bow riser, while the frame with adjustment mechanism is detached from the mounting plate, is rotated 180 degrees about a horizontal axis lying in a horizontal plane and then attached to the mounting plate.

The slider 58 may be attached to the front disc 66, the link arm 54 may be attached through the hole 56 to the rear disc 68, and the front disc 66 and rear disc 68 may be attached to the frame 24, with shoulder bolts with spring washers (not shown) to maintain a snug engagement.

Figure 7:
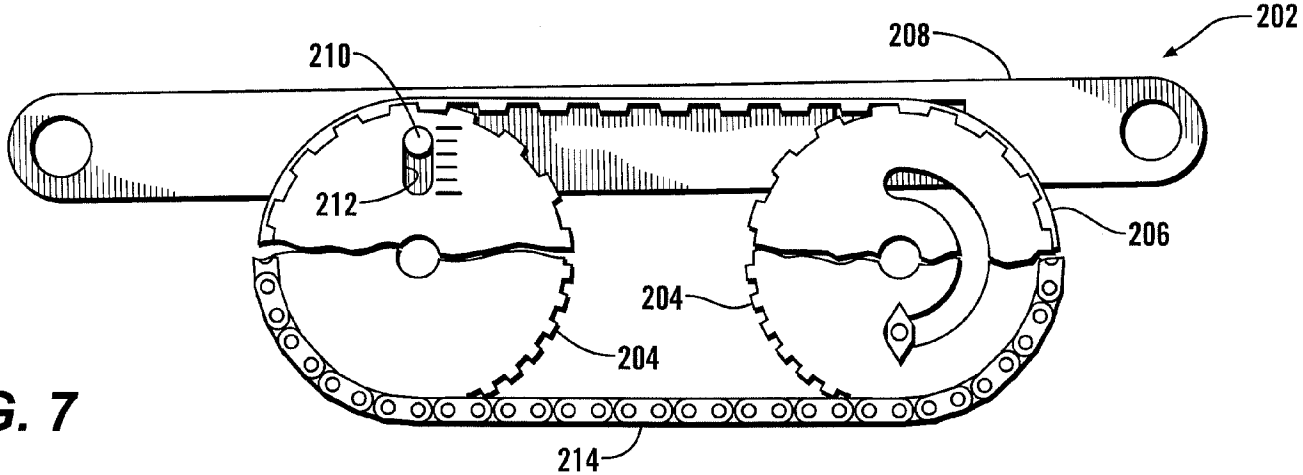
FIG. 7 is a side elevational view of alternative embodiment bow sights of this invention employing a timing belt or a linked chain.
Figure 8:
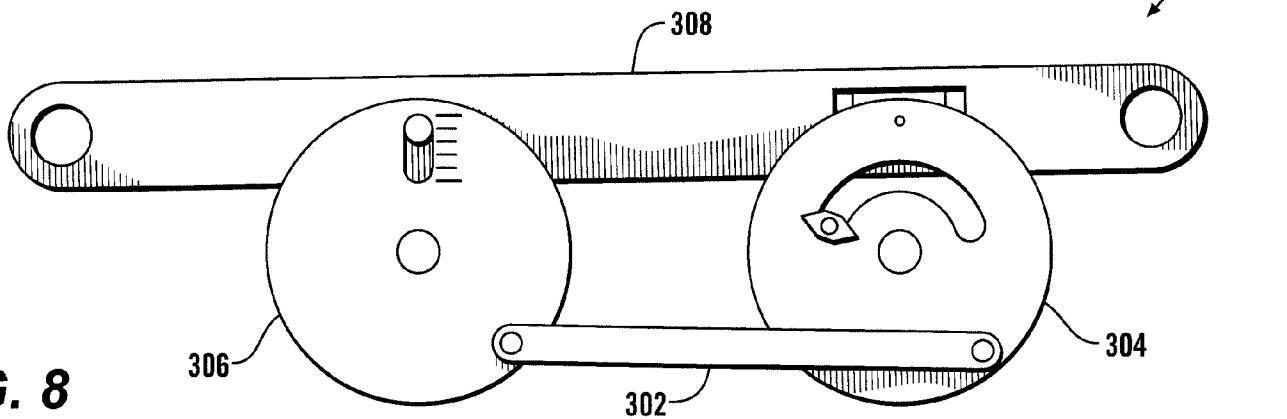
FIG. 8 is a side elevational view of another alternative embodiment bow sight of this invention employing a linkage between rotatable members.
Figure 13:
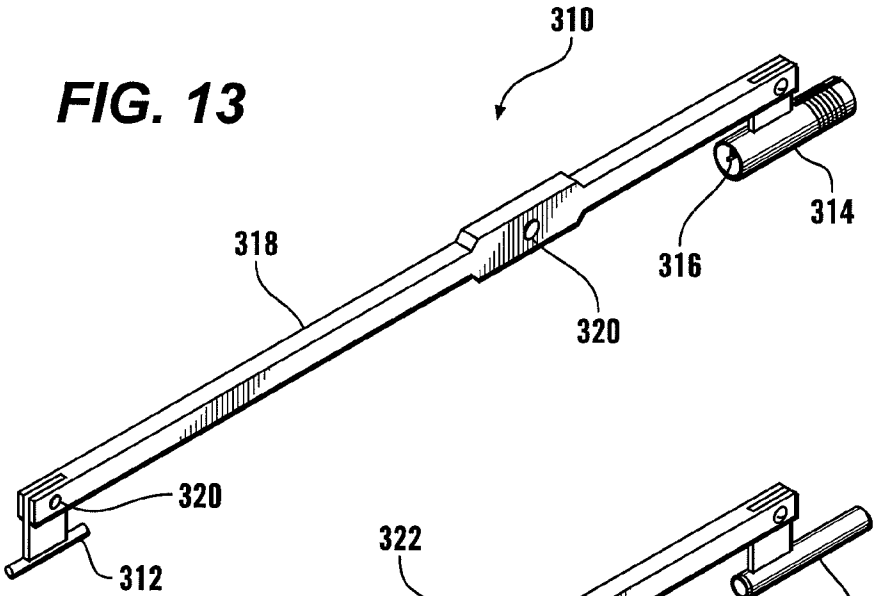
FIG. 13 is an isometric view of the alternative sight tube module of FIG. 12.

Several alternative embodiments of the bow sight adjustment mechanism are illustrated in FIGS. 7 and 8. A bow sight adjustment mechanism 202 is shown in the upper portion of FIG. 7 which employs two spaced gears or sprockets 204 which are connected by a flexible belt, such as a rubber timing belt 206. The belt 206 thus serves as a synchronizing connector between the sprockets which define two rotatable members. The adjustment of the attachment of the link arm 208 to the rear sprocket is achieved by a set screw 210 which when loosened can move radially in a slot 212 formed in the rear sprocket. Alternatively, a power transmission chain 214 similar to a bicycle chain may be used as the synchronizing connector in place of the timing belt, as shown in the lower portion of FIG. 7.

As shown in FIG. 8, an alternative adjustment mechanism 300 in the bow sight of this invention can utilize a synchronizing connector defined by a rigid synchronizing link 302 which is pin connected between a front disc 304 and a rear disc 306. The link arm 308 can be mounted to the rear disc 306 in the same fashion as in the mechanisms of FIG. 7. It should be noted that the rotatable members in an arrangement such as the one of FIG. 7 need not be discs, but can be rotatably mounted links of whatever desired shape. However, the angular range of motion of this mechanism 300 will be more limited than that of the previously discussed embodiments.

Figure 12:
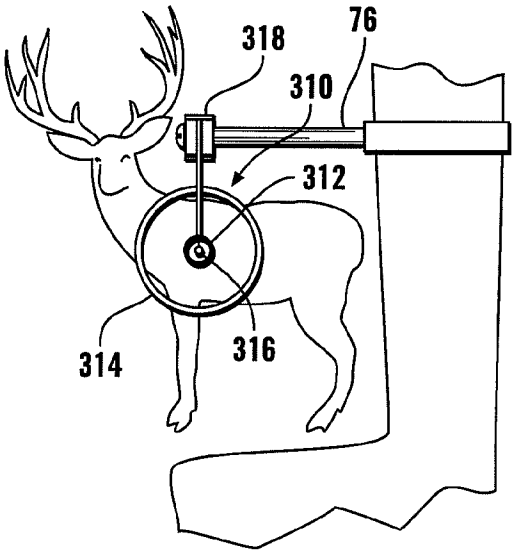
FIG. 12 is a perspective view of an alternative embodiment sight tube module shown on a target.

As shown in FIGS. 12-15, the sight tube which is attached to the bow sight by the two spacer rods 76, may be replaced with alternative sight tube modules to provide different sighting options. The sight tube module 310 shown in FIGS. 12 and 13 has two axially spaced tube portions separated by a gap. The near tube portion 312 which is closer to the archer is a cylinder which is narrower in diameter than the far tube portion 314, giving a sight picture as shown in FIG. 12 that is minimally obstructive of the target. For example, the near tube portion may be about 3/16 inches in diameter, while the far tube portion may be about ⅝ inches in diameter. The near tube portion 312 of the sight tube module 310 need not be supplied with fiber optic markers, while the far tube portion 314 may have a fiber optic center marker 316 with an optical fiber in a plastic sight pin similar to the ones discussed above. The two tube portions 312, 314 are connected to each other by a rigid bar 318. The bar is configured to be mounted to the spacer rods 76, such as by having cylindrical through holes 320 which receive the spacer rods. The sight tube module 310 is well suited to hunting applications, as it provides a clear sight picture with minimal obstruction, and the module itself does not extend significantly forward of the bow.

Figure 14:
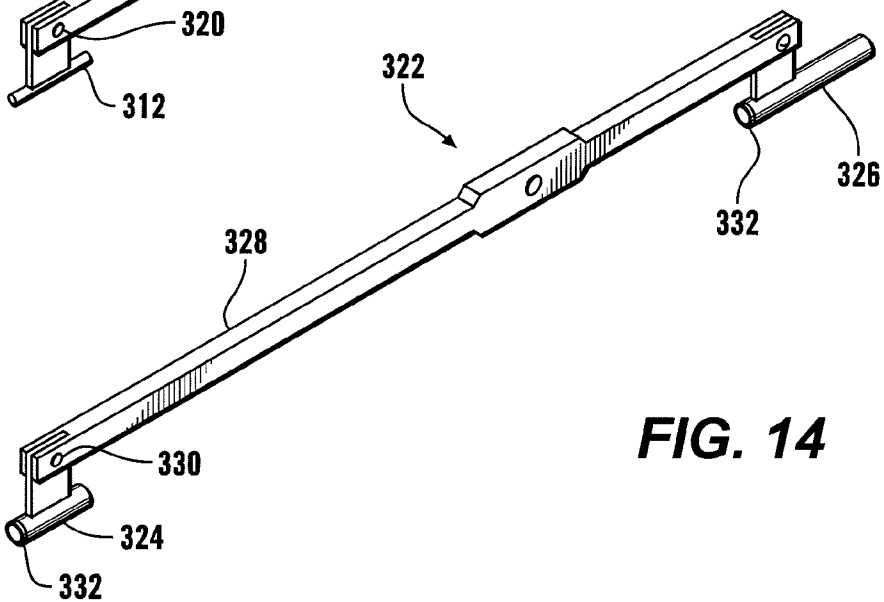
FIG. 14 an isometric view of another alternative embodiment sight tube module of this invention.
Figure 15:
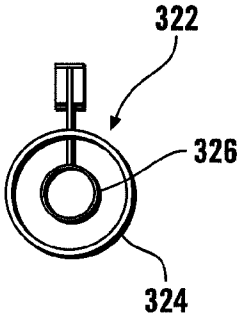
FIG. 15 is a perspective view of the sight picture through the sight tube module of FIG. 14.

As shown in FIGS. 14 and 15, an alternative embodiment sight tube module 322 has a near tube portion 324 and a far tube portion 326 connected by a rigid bar 328. Both tube portions 324, 326 have central axes which are aligned when mounted to the rigid bar 328. The bar 328 may be about thirteen inches from the near through hole 330 center to the far end of the bar. The sight picture of the sight tube module 322 is shown in FIG. 15, and comprises two centered circles. Each tube portion 324, 326 may be about ¼ inch in diameter, and have a colored near portion 332, formed for example by dipping the tube in paint or fluorescent coloring. The appearance to the archer is then of two narrow circular rings which are to be centered on the target. The module 310 may be of greater accuracy for use in indoor target applications, although both may be used for hunting. It should be noted that the rigid bar may be formed from multiple segments which telescope with respect to one another, to allow the adjustment of the spacing between the tube portions, and hence the appearance of the sight picture. A set screw may be then be employed to fix the telescoped bar at its selected length.

It should be noted that a number of different sight tube apparatus may be supplied to be interchangeably mounted to the bow sight to allow an archer to select the sight tube best suited to a particular archery application. Moreover, the length of the sight tube module rigid bar may be extended to have greater spacing between the sight tube portions, for example to have the far sight tube portion appear to be smaller for greater accuracy in sighting.

It is understood that the invention is not limited to the particular construction and arrangement of parts herein illustrated and described, but embraces all such modified forms thereof as come within the scope of the following claims.

I claim:

1. An archery bow sight for attachment to a bow, the bow sight comprising:

a frame for attachment to an upwardly extending member of the bow;

a first rotatable member mounted to the frame to rotate about a first axis point;

a second rotatable member mounted to the frame at a position rearward of the first rotatable member, wherein the second rotatable member rotates with respect to the frame about a second axis point;

a synchronizing connector extending between the first rotatable member and the second rotatable member, the synchronizing connector serving to coordinate the rotation between the first rotatable member and the second rotatable member such that rotation of one of said members results in a like rotation of the other member;

a range adjustment knob mounted to the frame and engaged with at least one of the first rotatable member and the second rotatable member to bring about the rotation of said rotatable members for adjustment of the sight for different target ranges;

a link extending between the first rotatable member and the second rotatable member, wherein the link is rotatably pinned to the first rotatable member at a first radial distance from the first axis point, and the link is rotatably pinned to the second rotatable member at a second distance from the second axis point, wherein the second distance is less than the first distance, and wherein the link is adjustable in inclination and height by the rotation of the range adjustment knob; and a sight tube fixed to the link such that an archer employing the sight can view a desired target through the sight tube.

2. The bow sight of claim 1 wherein the first rotatable member comprises a first gear mounted to the frame to rotate about the first axis point, and wherein the second rotatable member comprises a second gear mounted to the frame to rotate about the second axis point, and wherein the synchronizing connector comprises a third gear mounted to the frame and engaging both the first gear and the second gear.

3. The bow sight of claim 2 wherein the first gear and the second gear have a first quantity of gear teeth, and wherein the third gear has a quantity of teeth which is less than the first quantity, and further comprising a fourth gear which is mounted to the frame to engage one of the gears, the fourth gear having a quantity of teeth less than the third gear.

4. The bow sight of claim 1 wherein the first rotatable member comprises a first gear mounted to the frame to rotate about the first axis point, and wherein the second rotatable member comprises a second gear mounted to the frame to rotate about the second axis point, and wherein the synchronizing connector comprises a timing belt looped about the first gear and the second gear.

5. The bow sight of claim 1 wherein the first rotatable member comprises a first gear mounted to the frame to rotate about the first axis point, and wherein the second rotatable member comprises a second gear mounted to the frame to rotate about the second axis point, and wherein the synchronizing connector comprises a link chain looped about the first gear and the second gear.

6. The bow sight of claim 1 wherein the synchronizing connector comprises a rigid link extending between the first rotatable member and the second rotatable member.

7. The bow sight of claim 1 further comprising:

a first optical fiber positioned at one end of the sight tube; and a second optical fiber positioned at an opposite end of the sight tube, both optical fibers extending around the sight tube to gather light and display the light to a user of the bow sight within the sight tube.

8. The bow sight of claim 7 further comprising a first sight pin having a pin tube and a tab which extends radially outwardly from the pin tube, the tab being engaged with the sight tube, and wherein the first optical fiber extends axially into the pin tube and axially positionable therein.

9. The bow sight of claim 1 wherein the sight tube further comprises:

a tubular main segment;

a first sleeve which engages the main segment; and a first transparent cylinder having a colored face, the first transparent cylinder being engaged with the first sleeve and connected by the first sleeve to the main segment.

10. The bow sight of claim 1 wherein the link and the second rotatable member include structure to permit the adjustment of the second distance to accommodate different user draw lengths.

11. The bow sight of claim 10 wherein the second rotatable member has portions defining a plurality of mounting holes disposed at different locations around the second rotatable member, each mounting hole being at a different radial distance from the second axis point.

12. The bow sight of claim 10 wherein the link is connected to the second rotatable member by a pin which extends within a slot, the connection being adjustable to position the pin at different radial distances from the second axis point.

13. The bow sight of claim 1 wherein the sight tube comprises:

a first tube portion having a central axis and a first exterior radius; and a second tube portion positioned frontwardly of the first tube portion and also extending along the central axis, the second tube portion being spaced from the first tube portion and connected thereto by a connecting element.

14. The bow sight of claim 13 wherein the second tube portion has an exterior radius which is different than the first exterior radius.

15. An archery bow sight for attachment to a bow, the bow sight comprising:

a frame for attachment to an upwardly extending member of the bow;

a first rotatable member mounted to the frame to rotate about a first axis point;

a second rotatable member mounted to the frame at a position rearward of the first rotatable member, wherein the second rotatable member rotates with respect to the frame about a second axis point, wherein a synchronizing connector connects the first rotatable member to the second rotatable member;

a range adjustment knob mounted to the frame and engaged with at least one of the first rotatable member and the second rotatable member to bring about the rotation of said rotatable members for adjustment of the sight for different target ranges;

a link extending between the first rotatable member and the second rotatable member, wherein the link is rotatably connected to the first rotatable member at a first radial distance from the first axis point, and the link is rotatably connected to the second rotatable member at a second distance from the second axis point, wherein the second distance is less than the first distance, and wherein the link is adjustable in inclination and height by the rotation of the range adjustment knob, wherein the link and the second rotatable member are adjustably interengaged to permit the adjustment of the second distance to accommodate different user draw lengths; and a sight tube fixed to the link such that an archer employing the sight can view a desired target through the sight tube.

16. The bow sight of claim 15 wherein the second rotatable member has portions defining a plurality of mounting holes disposed at different locations around the second rotatable member, each mounting hole being at a different radial distance from the second axis point.

17. The bow sight of claim 15 wherein the link is connected to the second rotatable member by a pin which extends within a slot, the connection being adjustable to position the pin at different radial distances from the second axis point.

18. The bow sight of claim 15 wherein the first rotatable member comprises a first gear mounted to the frame to rotate about the first axis point, and wherein the second rotatable member comprises a second gear mounted to the frame to rotate about the second axis point, and wherein the synchronizing connector comprises a third gear mounted to the frame and engaging both the first gear and the second gear.

19. The bow sight of claim 18 wherein the first gear and the second gear have a first quantity of gear teeth, and wherein the third gear has a quantity of teeth which is less than the first quantity, and further comprising a fourth gear which is mounted to the frame to engage one of the gears, the fourth gear having a quantity of teeth less than the third gear.

20. The bow sight of claim 15 wherein the first rotatable member comprises a first gear mounted to the frame to rotate about the first axis point, and wherein the second rotatable member comprises a second gear mounted to the frame to rotate about the second axis point, and wherein the synchronizing connector comprises a timing belt looped about the first gear and the second gear.

21. The bow sight of claim 15 wherein the first rotatable member comprises a first gear mounted to the frame to rotate about the first axis point, and wherein the second rotatable member comprises a second gear mounted to the frame to rotate about the second axis point, and wherein the synchronizing connector comprises a link chain looped about the first gear and the second gear.

22. The bow sight of claim 15 wherein the synchronizing connector comprises a rigid link extending between the first rotatable member and the second rotatable member.

23. An archery bow sight assembly for attachment to a bow, the bow sight assembly comprising:

a frame for attachment to an upwardly extending member of the bow;

a first rotatable member mounted to the frame to rotate about a first axis point;

a second rotatable member mounted to the frame at a position rearward of the first rotatable member, wherein the second rotatable member rotates with respect to the frame about a second axis point;

a synchronizing connector extending between the first rotatable member and the second rotatable member, the synchronizing connector serving to coordinate the rotation between the first rotatable member and the second rotatable member such that rotation of one of said members results in a like rotation of the other member;

a range adjustment knob mounted to the frame and driving at least one of the first rotatable member and the second rotatable member to bring about the rotation of said rotatable members for adjustment of the accessory for different target ranges;

a link extending between the first rotatable member and the second rotatable member, wherein the link is rotatably pinned to the first rotatable member at a first radial distance from the first axis point, and the link is rotatably pinned to the second rotatable member at a second distance from the second axis point, wherein the second distance is less than the first distance, and wherein the link is adjustable in inclination and height by the rotation of the range adjustment knob; and a sight element fixed to the link such that an archer employing the bow sight assembly can view a desired target and target the bow.

24. The bow sight assembly of claim 23 wherein the link and the second rotatable member include structure to permit the adjustment of the second distance to accommodate different user draw lengths.

* * * * *